United States Patent [19]

Ollis et al.

[11] Patent Number: 4,487,420

[45] Date of Patent: Dec. 11, 1984

[54] DARTS

[76] Inventors: Martin G. Ollis, Butler's Leap, Clifton Road Industrial Estate; John E. Hart, 10 Barton Rd., both of Rugby, Warwickshire, England

[21] Appl. No.: 397,823

[22] Filed: Jul. 13, 1982 (Under 37 CFR 1.47)

Related U.S. Application Data

[63] Continuation-in-part of Ser. No. 128,911, Mar. 10, 1980, abandoned.

[51] Int. Cl.[3] ..... A63B 65/02

[52] U.S. Cl. ..... 273/423

[58] Field of Search ..... 273/416, 419, 420, 423

[56] References Cited

FOREIGN PATENT DOCUMENTS

| | | | |
|---|---|---|---|
| 121476 | 6/1946 | Australia | 273/423 |
| 45762 | 9/1935 | France | 273/420 |
| 484292 | 5/1938 | United Kingdom . | |
| 584993 | 1/1947 | United Kingdom | 273/423 |
| 608736 | 9/1948 | United Kingdom | 273/423 |

*Primary Examiner*—Paul E. Shapiro

*Attorney, Agent, or Firm*—C. O. Marshall, Jr.

[57] ABSTRACT

A dart is described having a shaft to carry the flight, with a slot opening diametrically through the thickness of the shaft so that the flight can be deformed to a flat condition and pushed laterally through the slot, the extreme end of the shaft behind the flight being closed and pointed or rounded to provide a deflection surface in the event of contact by a further dart.

7 Claims, 3 Drawing Figures

DARTS

CROSS REFERENCE TO RELATED APPLICATION

This application is a continuation-in-part of application Ser. No. 06/128,911 filed Mar. 10, 1980, now abondoned.

DESCRIPTION

This invention relates to darts as used in the game of the same name.

As well known, a dart comprises a spike projecting forwardly from a body, a shaft projecting rearwardly from the body, and a flight often consisting of four vanes which extend radially at 90° intervals from the rear end of the shaft. In ordinary games of darts, each player throws three darts in succession. If one of the later darts hits one of the earlier darts, and if it is the flight which is hit, the vane will probably deflect and subsequently recover; if the body is hit, the shape of the latter is often such that the following dart will simply be deflected; but if the shaft is hit it may be damaged.

Relatively cheap darts often have flights made of molded plastic and provided with a male screw-threaded portion which engages a female screw-threaded socket in the rear of the body, so that the plastic forms at least a short shaft portion. Impact by a following dart which damages the flight can be repaired by replacing the complete flight including shaft and vanes. However, the shaft has to be made of the same material as the vanes in this case, and is therefore likely to be deformed easily and these darts are not only relatively cheap, but are also of relatively low quality.

Darts of higher quality are known in which the shaft consists of metal provided with a cruciform slot opening to one end, so that a plastics flight consisting only of four vanes without any integral shaft portion can be pushed into the slot. The flight is gripped by the slots. The problem here is that if the following dart point hits the shaft at the rear it may split off one of the segments lying between two of the slot portions, and then possibly the whole shaft has to be replaced.

It is also known to provide a shaft with a diametric slot through which the flight is displaced laterally in assembly, so that the vanes end up disposed on each side of the slot. The problem here is that the flight is not positively located and if it moves relative to the shaft the ballistic properties are impaired and the flight of the dart is erratic.

The objects of the invention are to provide solutions to these problems.

In accordance with the invention a dart shaft has a slot extending generally diametrically through its thickness and terminating short of both ends of the shaft, the slot being of minimum transverse dimension in a plane containing the longitudinal arms of the shaft, and the slot walls diverging on both sides of such plane generally at right angles to one another, whereby a one-piece flight having four vanes may be inserted in the slot to cause each of the four vanes to extend radially of the shaft axes while lying against a wall of the slot.

By these means, a flight of the kind comprising four vanes extending generally at 90° intervals can be folded to a flat condition and pushed through the slot laterally, instead of being pushed into the cruciform slot of the known dart axially of the shaft; because there is a portion of solid material at each end of the shaft, there is less likelihood of damage from the following dart: but the vanes are positively located by the flat walls.

The shaft which is so provided, may be secured to the dart body either permanently or detachably so as to allow for replacement in the event of accidental damage, for example through being trod on, and in the detachable case may be provided with screwthreads to engage complementary threads in the dart body, or may be made with a tapered end portion so as to be a wedge fit in a complementary taper in the body.

By these means, the flight can be of relatively cheap material so as to be replaceable in the event of damage at low cost, whilst the shaft can be made of relatively expensive material so as to give the best possible throwing qualities for the dart.

In particular, the shaft could be made of titanium or an alloy of the same so that it can be made of very slim cross-section between its ends, being enlarged only at the end where it is attached to the body.

The invention is now more particularly described with reference to the accompanying drawings wherein.

Figure 1:
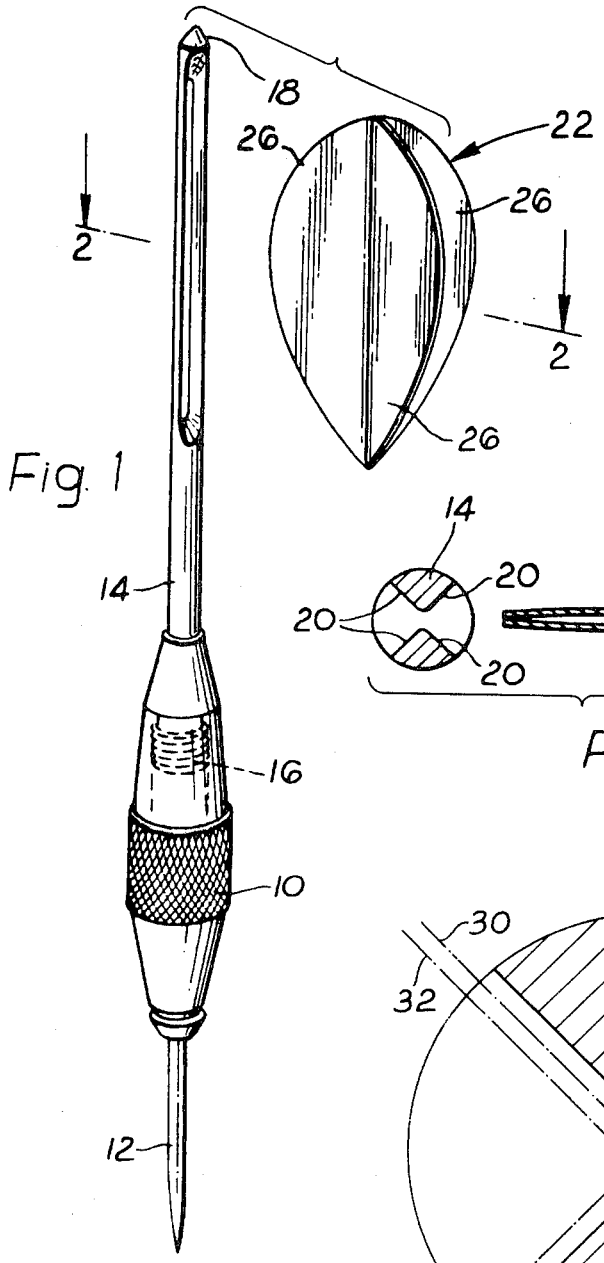
FIG. 1 is a view showing a dart according to one aspect of the invention, and showing the flight of the same about to be engaged or assembled to the dart.

Turning now to FIG. 1, the dart comprises a body 10 provided with a point or spike 12 at one end, and with a shaft 14 at the other end, co-axial with the point. The shaft 14 is engaged with the body by means of complementary screw threaded parts shown by the reference numeral 16.

Figure 3:
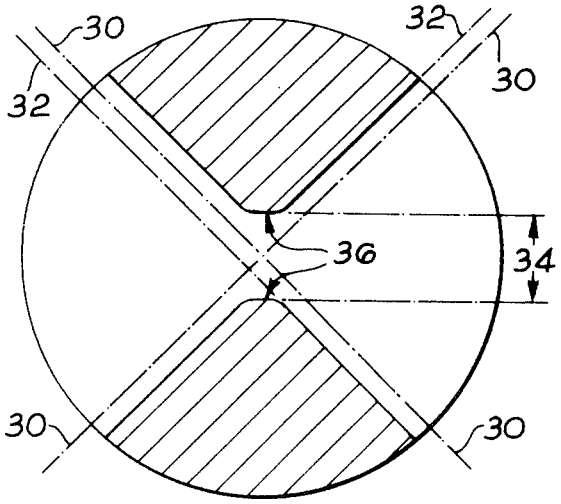
FIG. 3 is a further enlarged cross-section of the shaft.

The shaft 14 is, in the embodiment, of circular cross-section and has a slot extending along its length terminating short of its rear end 18, the slot being formed by a pair of shallow recesses located generally on diametric sides of the shaft, as best seen in FIG. 3. It will be seen that the two walls of each recess, indicated by the reference numerals 20 lie in a pair of planes generally at right angles to one another.

However, one wall of one recess is not co-planar with the generally diametrically opposed wall of the opposite recess. The chain-dot lines 30, 30 in FIG. 3 represent true radial planes, whereas the lines 32, 32 represent co-linear extensions of the said walls.

The lines 30, 32, are parallel but surprisingly are not spaced apart by a distance which is one half of the thickness of each flight vane 26 (as hereinafter described) although that would be the calculable dimension separating those lines. The inventor has discovered that a separation between 60% and 90% of that calculable dimension and preferably 75% of that calcuable dimension gives superior results, when applied to all four walls, in gripping the flight without deforming the vanes.

Moreover, it will be noted that each pair of walls made up of one from each recess do not meet at an apex but are radiussed to a flat intervening face 36 and those faces 36 are symmetrical to the recesses and are respectively spaced apart by a dimension 34. This latter dimension is in excess of twice the vane thickness, and is preferably less than four times the vane thickness. A preferred dimension is 3 times the thickness and experimentally this is found to give maximum possible contact with the vanes, i.e. the radially longest possible walls, without leading to difficulties in flight location.

Figure 2:
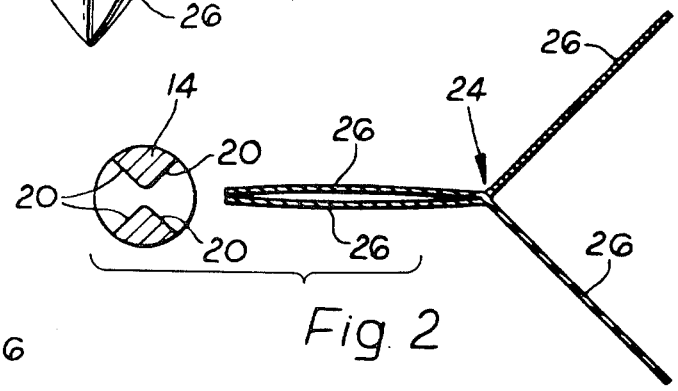
FIG. 2 is an enlarged sectional view taken on the line 2—2 of FIG. 1.

The flight, indicated by the reference numeral 22 is made for example from a pair of generally planar shapes of a plastics or like material which have been joined along the line 24, for example by a high frequency welding operation, and thus forming four vanes 26 which normally lie at 90° intervals around the axis of the flight. Such a vane may have a pair of the vanes closed together, as shown in FIG. 2, so that these can be passed through the slot, and they will then recover their original position, lying against the walls 20 of the slot.

It will be noted that the end 18 is pointed or otherwise shaped so as to provide a deflection surface in the event of contact by the point of a following dart.

Having now described my invention what I claim is:

1. A dart comprising a flight having four vanes connected along a central axis and a one-piece dart shaft having a slot extending generally diametrically through its thickness and terminating short of both ends of the shaft, the slot being of minimum traverse dimension in a plane containing the longitudinal axis of the shaft, said slot being defined by four walls, each pair of walls on opposite sides of such plane comprising generally flat surfaces of said shaft at generally right angles to each other, and each wall of one pair lying generally parallel to a different one of the walls of the other pair, said minimum transverse dimension being at least as great as the combined thickness of any two adjacent vanes such that said flight may be inserted in the slot to cause each of the four vanes to extend radially of the shaft axis while lying against a wall of the slot.

2. A dart as claimed in claim 1 wherein the rear end of the shaft is shaped to deflect the point of an arriving dart.

3. A dart as claimed in claim 1 wherein each said slot wall is parallel to a radial plane containing the said longitudinal axis.

4. A dart as claimed in claim 3 wherein each said slot wall is spaced from said radial plane by a dimension lying between 30% and 45% of the vane thickness.

5. A dart as claimed in claim 4 wherein said dimension is about 37½%.

6. A dart as claimed in claim 1 wherein each two slot walls (comprising one wall from one of said pairs and one wall from the other of said pairs) merge into faces which are parallel and symmetrical, and are spaced apart by a dimension which is less than four times the vane thickness.

7. A dart as claimed in claim 6 wherein said dimension is about three times the vane thickness.

* * * * *